US005934536A

United States Patent [19]

Shore et al.

[11] Patent Number: 5,934,536

[45] Date of Patent: Aug. 10, 1999

[54] ADJUSTABLE TURNDOWN APPARATUS

[75] Inventors: T. Michael Shore, Princeton; Melicher Puchovsky, Dudley, both of Mass.

[73] Assignee: Morgan Construction Company, Worcester, Mass.

[21] Appl. No.: 09/034,387

[22] Filed: Mar. 4, 1998

[51] Int. Cl.[6] ..... B65H 20/00

[52] U.S. Cl. ..... 226/177; 226/189

[58] Field of Search ..... 226/176, 177, 226/181, 189

[56] References Cited

U.S. PATENT DOCUMENTS

| | | | |
|---|---|---|---|
| 2,796,781 | 6/1957 | Mills | 226/176 X |
| 3,014,628 | 12/1961 | Littlehale | 226/177 |
| 3,052,393 | 9/1962 | McKenzie | 226/177 |
| 3,430,832 | 3/1969 | Meyer | 226/177 X |
| 3,506,174 | 4/1970 | Shuey, Jr. | 226/177 X |
| 3,596,706 | 8/1971 | Knorr | 226/189 X |
| 3,610,498 | 10/1971 | Gilvar . | |
| 3,680,758 | 8/1972 | Kinnicutt, Jr. . | |
| 3,761,003 | 9/1973 | Sieurin . | |
| 3,777,964 | 12/1973 | Kruner et al. . | |
| 3,785,543 | 1/1974 | Lee | 226/189 X |
| 5,343,934 | 9/1994 | Wilson | 226/177 X |

*Primary Examiner*—Michael Mansen
*Attorney, Agent, or Firm*—Samuels, Gauthier & Stevens

[57] ABSTRACT

A turndown apparatus has first and second guide rollers arranged respectively along the inside and outside of a curved path along which bendable products such as bars, rods and the like move at high speeds. The guide rollers coact in pairs to define gaps spaced along the curved path, and a mechanism is provided for symmetrically adjusting the gaps defined between the guide rollers in order to accommodate different product sizes.

9 Claims, 7 Drawing Sheets

ADJUSTABLE TURNDOWN APPARATUS

BACKGROUND OF THE INVENTION

1. Field of the Invention

This invention relates generally to rolling mills producing hot rolled rods, bars and other like bendable elongated products, and is concerned in particular with an improved apparatus for guiding such products as they move longitudinally at high speeds along curved paths.

2. Description of the Prior Art

In a typical modern day rod mill, delivery speeds range from about 5 to 150 m/sec, with rod diameters ranging from about 5.0 to 22.4 mm. As the hot rolled product exits from the mill, it is directed longitudinally along a horizontal path leading through a succession of water boxes before being guided downwardly by a "turndown" apparatus into an inclined laying head. The laying head forms the rod into a succession of rings which are received in an overlapping offset pattern on a conveyor. While on the conveyor, the rings are subjected to various thermal treatments before finally being delivered to a reforming chamber in which they are gathered into large coils.

Conventional turndowns typically employ pairs of guide rollers between which the product is guided along a downwardly curved path leading to the laying head. The spacing between the guide rollers is not adjustable to accommodate different product diameters. Thus, when the rolling schedule calls for a change in product size, for example from 5 to 10 mm., the mill must be shut down so that the guide rollers of the turndown can be changed to a different diameter selected to accommodate the next product size. Alternatively, the turndown can be provided with multiple pairs of different diameter guide rollers coaxially mounted on the same support shafts. In such cases, the entire turndown must be shifted in the direction of the roller axes so as to align differently sized roller pairs with the guide path.

Considerable costs are involved in maintaining the required inventory of different diameter guide rollers. Moreover, valuable production time is lost when changing from one guide roller size to another in order to accommodate different product sizes.

The objective of the present invention is to eliminate the above noted problems by providing an improved turndown apparatus which is capable of handing a wide range of product sizes with the same size guide rollers.

A companion objective of the present invention is the provision of a turndown apparatus which is readily adjustable to accommodate different product sizes, thereby minimizing lost production time with a concomitant improvement in mill efficiency.

SUMMARY OF THE INVENTION

In a preferred embodiment of the invention to be described hereinafter in greater detail, these and other objectives and advantages are achieved by arranging first and second guide rollers respectively along the inside and outside of the curved path along which the longitudinally moving product is to be directed. The first and second guide rollers are supported respectively on first and second frame members, and are arranged in pairs to define gaps therebetween spaced along the curved path. The frame members are adjustable symmetrically in opposite directions relative to the curved path to vary the size of the gaps defined between the guide roller pairs, and the guide rollers are rotatably driven.

DETAILED DESCRIPTION OF THE ILLUSTRATED EMBODIMENTS

Figure 1:
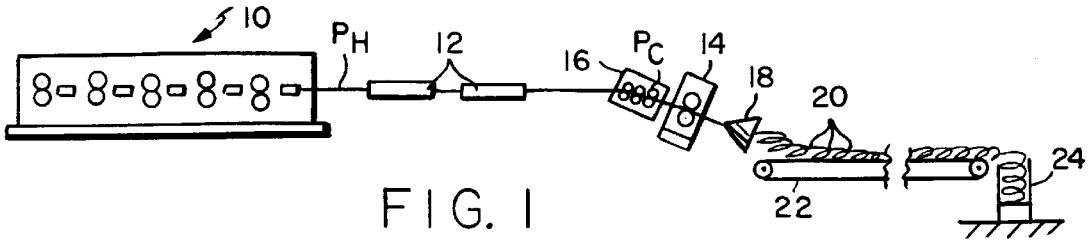
FIG. 1 is a diagrammatic illustration depicting the location of a turndown apparatus in accordance with the present invention at the delivery end of a rod mill.

With reference initially to FIG. 1, the delivery end of a rod rolling mill is shown comprising a multi stand finishing block 10 from which hot rolled steel rod exits along a horizontal delivery path $P_H$. The rod is typically directed through one or more water cooling boxes 12 to a turndown apparatus 16 in accordance with the present invention. The turndown apparatus directs the product downwardly along a curved path $P_C$ through a pinch roll unit 14 into a laying head 18 which forms the rod into a series of rings 20. The rings are received in an overlapping offset pattern on a conveyor 22. While being transported on the conveyor, the rings are subjected to various thermal treatments, e.g. controlled cooling, and are then delivered to a reforming chamber 24 where they are gathered into coils.

Referring, additionally to FIGS. 2–5, the turndown apparatus 16 is mounted on a base structure 26 inclined at an angle of approximately 10 to 20° or more with respect to the horizontal delivery path $P_H$. It will be understood that this angle of inclination may vary from one installation to the next, depending for example on the type, location and relative elevation of the downstream laying head 18, which is partially depicted in broken lines in FIG. 2.

Figure 5:
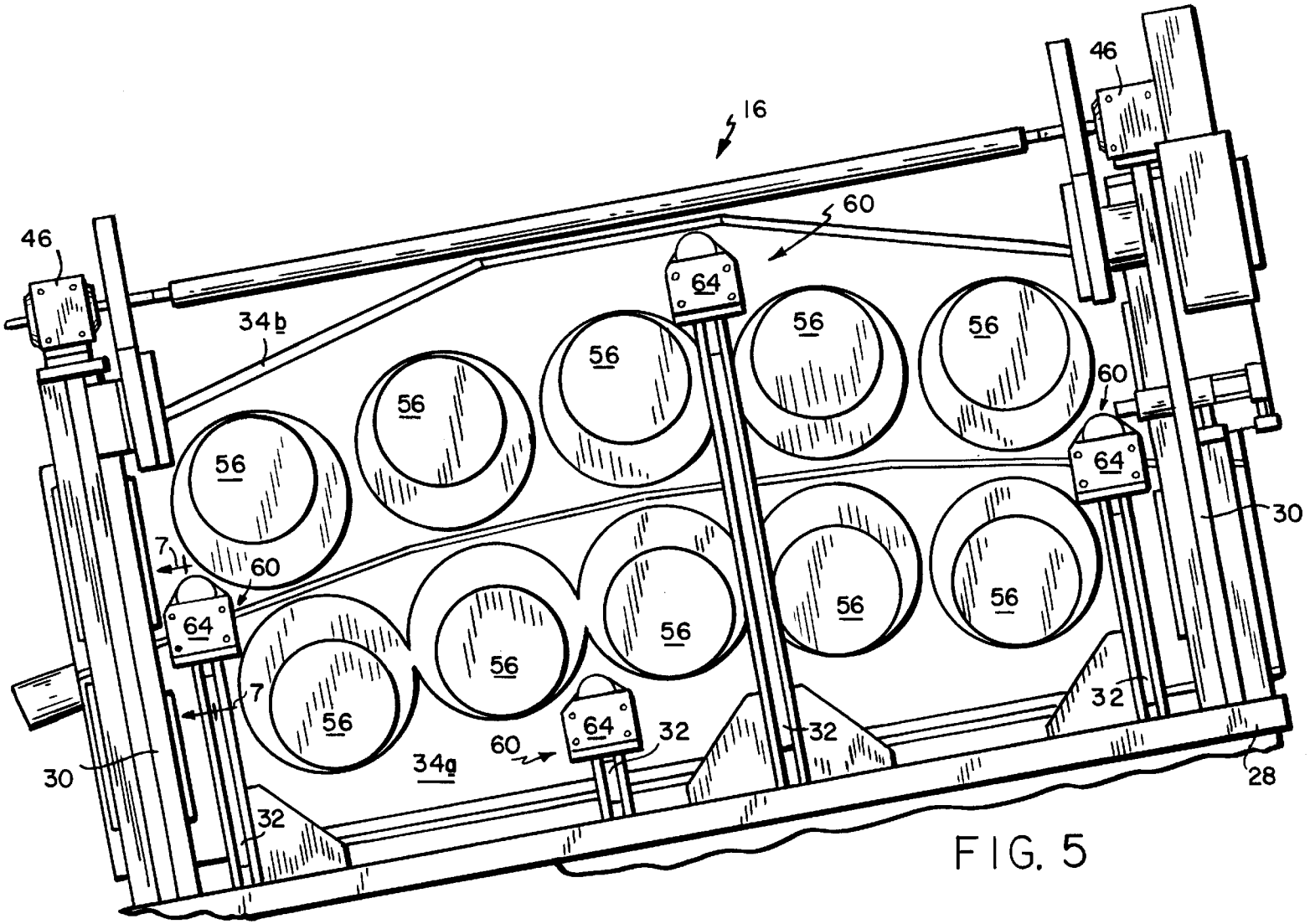
FIG. 5 is a rear view of the turndown apparatus.

The turndown apparatus includes a base plate 28 with, as can best be seen in FIG. 5, upstanding pedestals 30 at either end, and with clamp supporting posts 32 spaced at intervals therebetween.

Figure 3A:
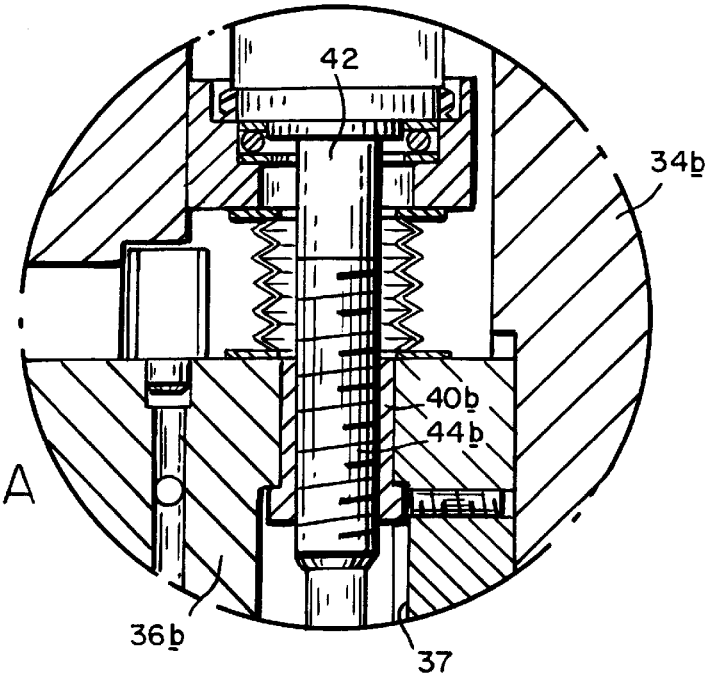
FIG. 3A is a further enlarged sectional view of a portion of the adjustment mechanism diagrammatically encircled in FIG. 3.
Figure 6:
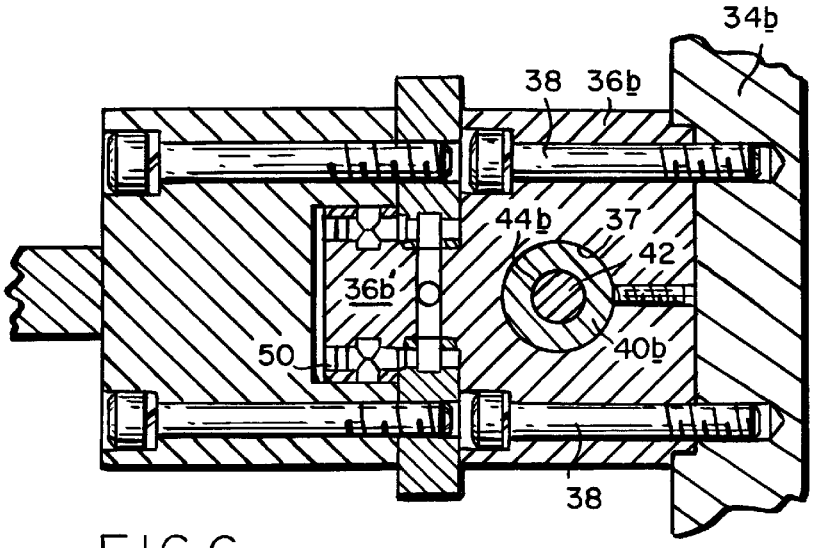
FIG. 6 is a sectional view taken along line 6—6 of FIG. 3.

First and second frame members 34*a*, 34*b* are mounted for vertical movement in opposite directions with respect to the pedestals 30. With reference additionally to FIGS. 3A and 6, it will be seen that the frame members are provided respectively with vertical ribs 36*a*, 36*b* secured to the back sides thereof by bolts 38. The ribs 36*a*, 36*b* have vertical through bores 37 containing opposite hand nuts 40*a*, 40*b*. Spindles 42 have opposite hand screw segments 44*a*, 44*b* threaded through the nuts 40*a*, 40*b* to establish a mechanical interconnection between the frame members 34*a*, 34*b*. The spindles 42 depend from right angle gear boxes 46 mounted at the upper ends of the pedestals 30. The gear boxes 46 are mechanically interconnected by a horizontal spindle 48 and are jointly driven by a handwheel 50. The ribs 36*a,* 36*b* have relatively narrow segments 36*a′,* 36*b′* which protrude rearwardly into vertical recesses 52 in the pedestals 30.

First and second guide roller 54*a,* 54*b* are arranged respectively along the inside and outside of the curved guide path $P_C$, and are carried respectively on the first and second frame members 34*a,* 34*b*. The guide rollers are individually rotatably driven by motors 56 carried by the frame members 34*a,* 34*b,* and are arranged in pairs to define gaps 58 therebetween spaced along the curved guide path $P_C$.

With this arrangement, rotation of the handwheel 50 will act through the gear boxes 46 interconnected by the horizontal spindle 48 to simultaneously rotate the vertical spindles 42. This in turn will serve to simultaneously adjust the frame members 34*a,* 34*b* in opposite directions, with corresponding adjustments being made to the gaps 58 defined between the coacting pairs of guide rollers 54*a,* 54*b*. Depending on the direction of rotation of the handwheel 50, the gaps 58 will either be widened or narrowed to accommodate changes in the size of the product being rolled by the mill. This adjustment can be made quickly, and without having to change the individual guide rollers. The guide rollers are enclosed by a cover 59 which may be opened to the position shown by the broken lines at 59' in FIG. 3.

Figure 7:
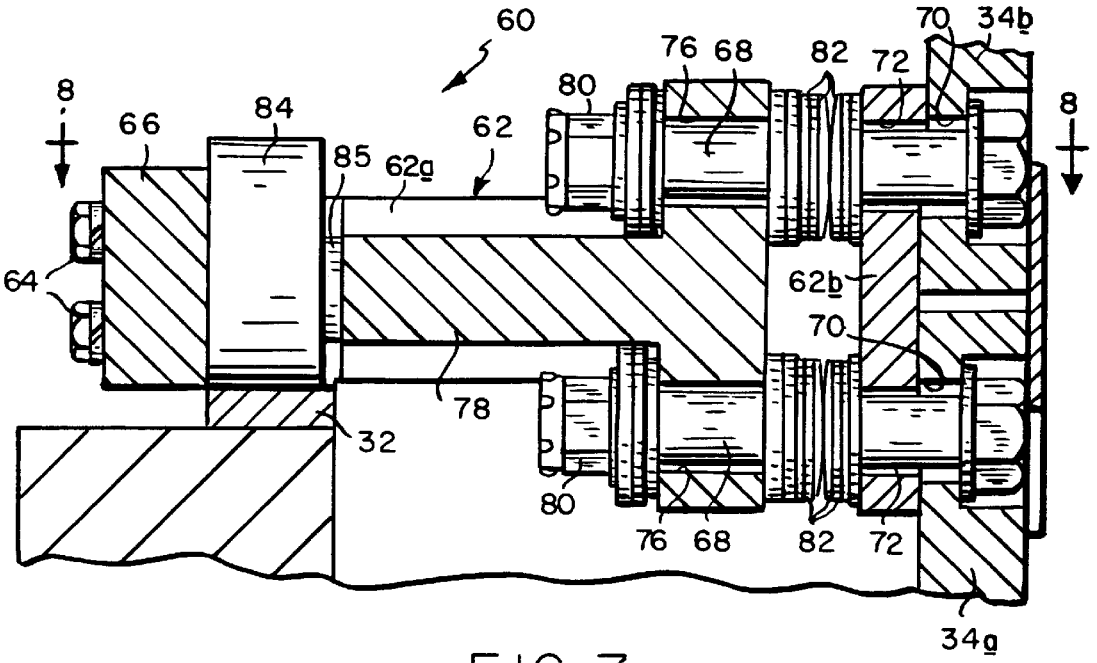
FIG. 7 is a sectional view of a clamp assembly taken along line 7—7 of FIG. 5.
Figure 8:
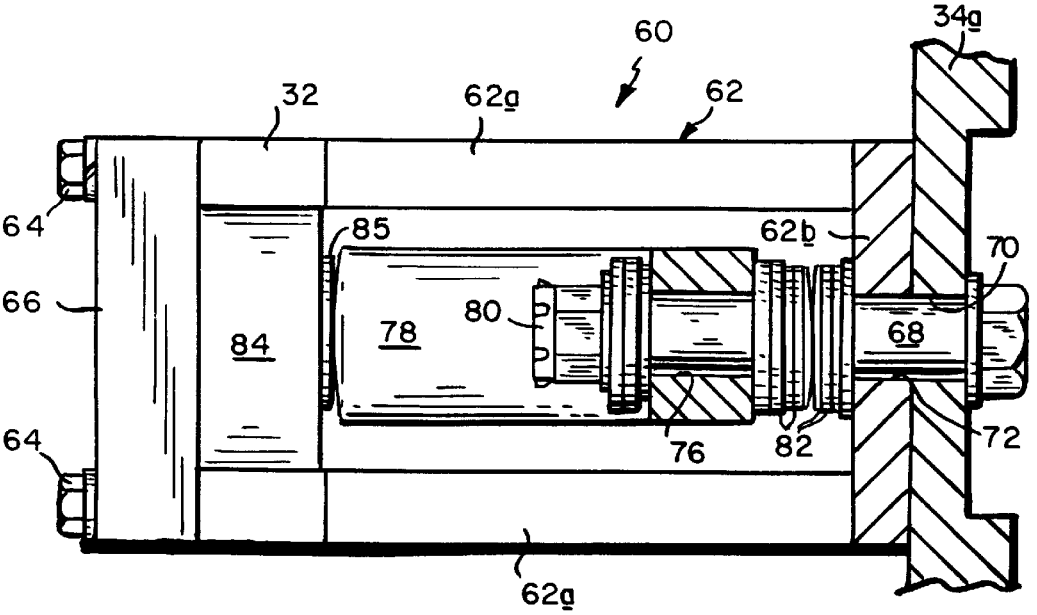
FIG. 8 is a view taken along line 8—8 of FIG. 7.

During rolling, and between adjustments to the gaps 58, the frame members 34*a,* 34*b* are immobilized by releasable clamp assemblies 60 (see FIG. 5) carried on the posts 32. With reference to FIGS. 7 and 8, a typical clamp assembly 60 comprises a U-shaped bracket 62 having its legs 62*a* fixed to the forked upper end of a respective support post 32 by bolts 64 extending through a bridging plate 66, and having its base 62*b* abutting one or both of the frame members 34*a,* 34*b*. Connecting bolts 68 extend horizontally through vertically elongated slots 70 in the frame members 34*a,* 34*b,* through holes 72 in the base 62*b* of bracket 62, and through holes 76 in the head of a T-shaped ram 78. Castle nuts 80 are threaded onto the ends of the bolts 68, and heavy duty spring washers 82 are captured on the bolts 68 between the base 62*b* of bracket 62 and the head of ram 78. A cylinder 84 with an extensible piston 85 is located between bridging plate 66 and the base of ram 78. In the clamped state, the piston 85 is retracted, allowing the spring washers 82 to expand, and pull the frame members 34*a,* 34*b* against the base 62*b* of the bracket 62, thereby frictionally immobilizing them from movement relative to the path $P_C$. Actuation of the cylinder 84 extends the piston 85, which acts through ram 78 to compress the spring washer 82, thereby freeing the frame members 43*a,* 43*b* for movement relative to the base 62*b* of the fixed bracket 62. The frame members may then be adjusted by rotation of the handwheel 50 as described previously. The range of possible adjustment is accommodated by the slots 70 in the frame members. Once the desired adjustment has been effected, the cylinder 84 is deactivated, allowing the spring washers 82 to expand to again clamp the frame members 43*a,* 34*b* against the base 62*b* of the fixed bracket 62. It will be apparent from FIG. 5 that the clamp assemblies can either act on both frame members 34*a,* 34*b,* or on one or the other of the frame members.

Figure 2:
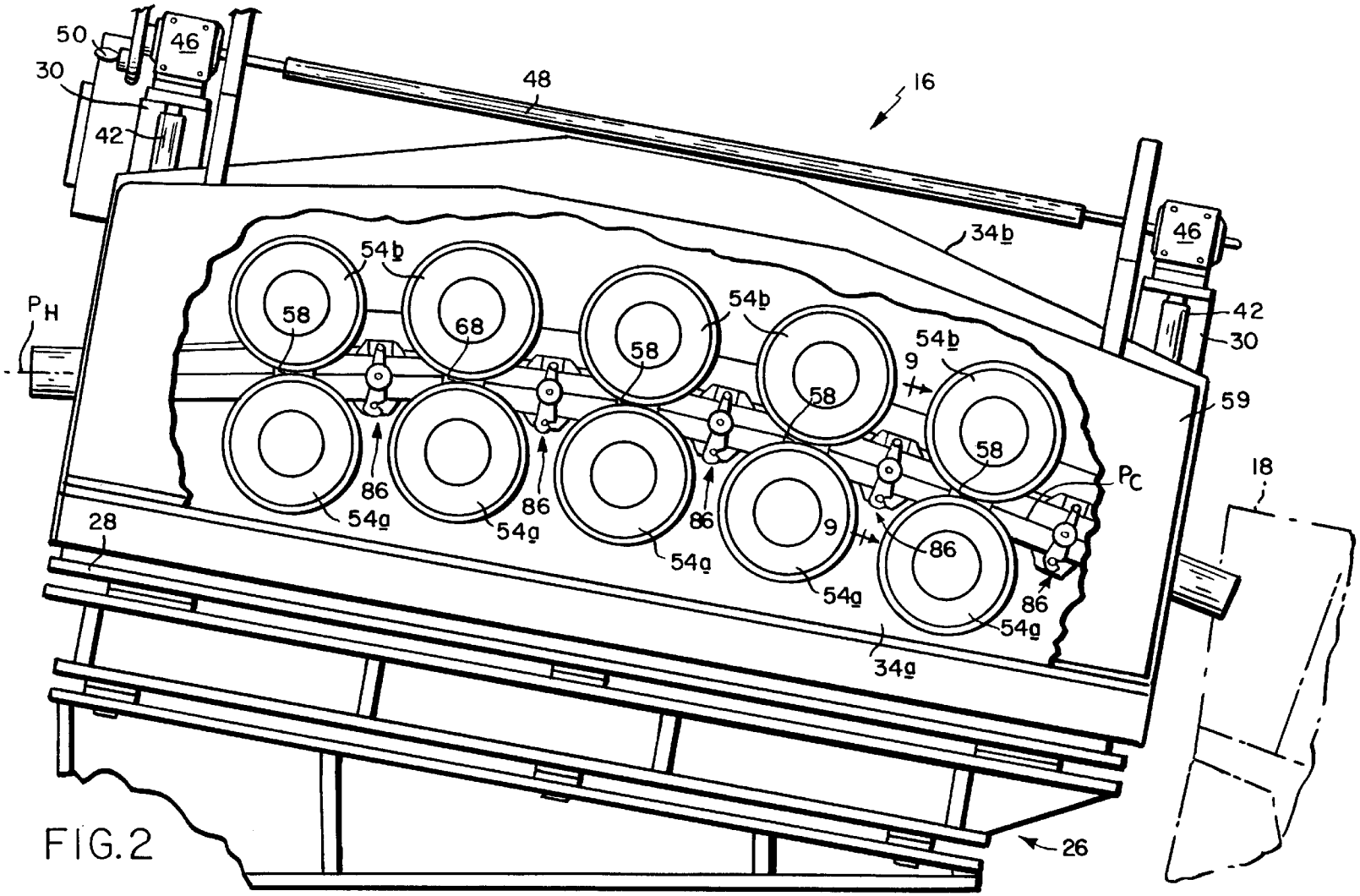
FIG. 2 is a front view of the turndown apparatus with portions of the pivotal housing cover broken away.
Figure 3:
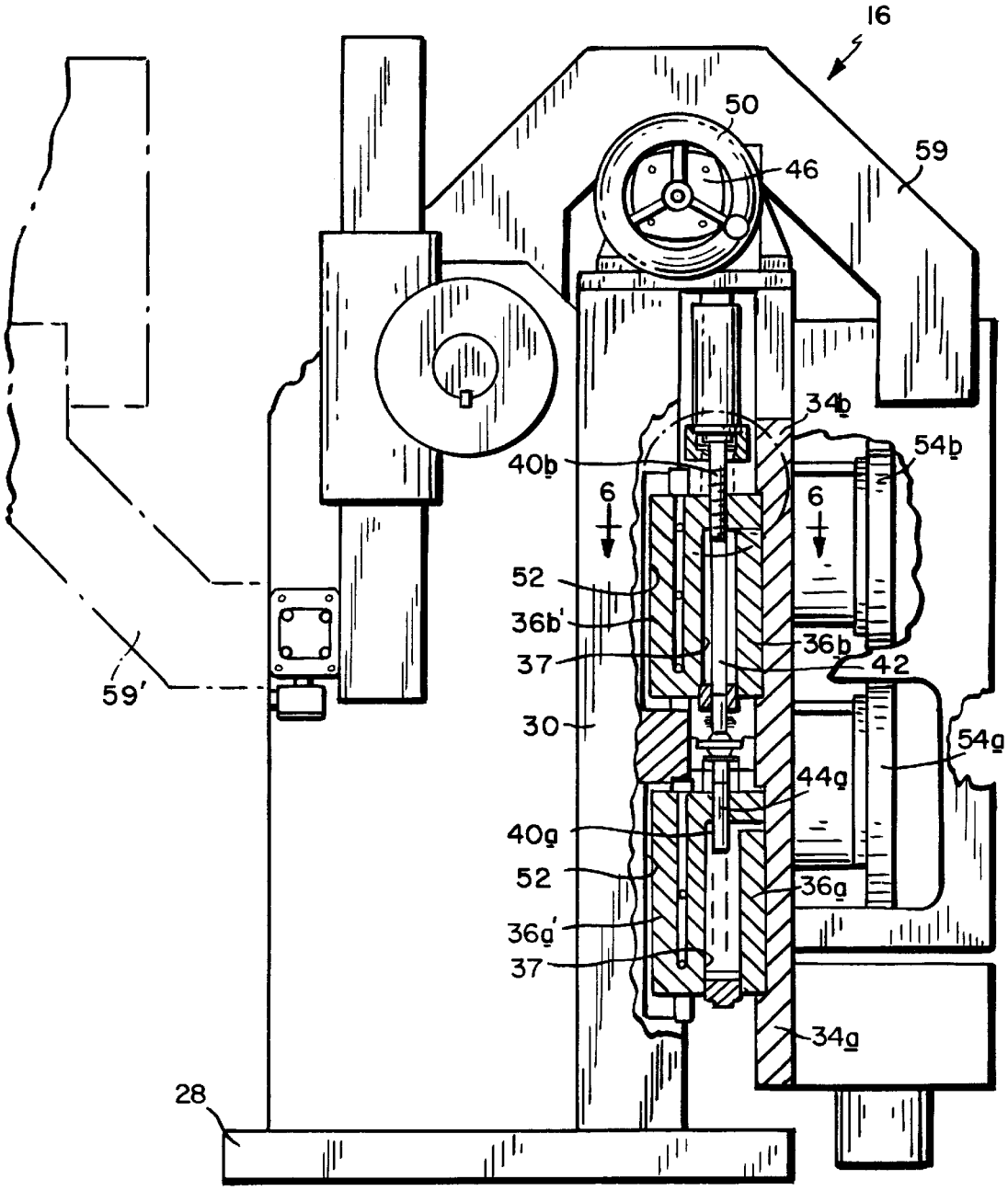
FIG. 3 is a slightly enlarged end view of the turndown apparatus looking from left to right in FIG. 2, with portions of the pivotal housing cover and other components broken away.
Figure 4:
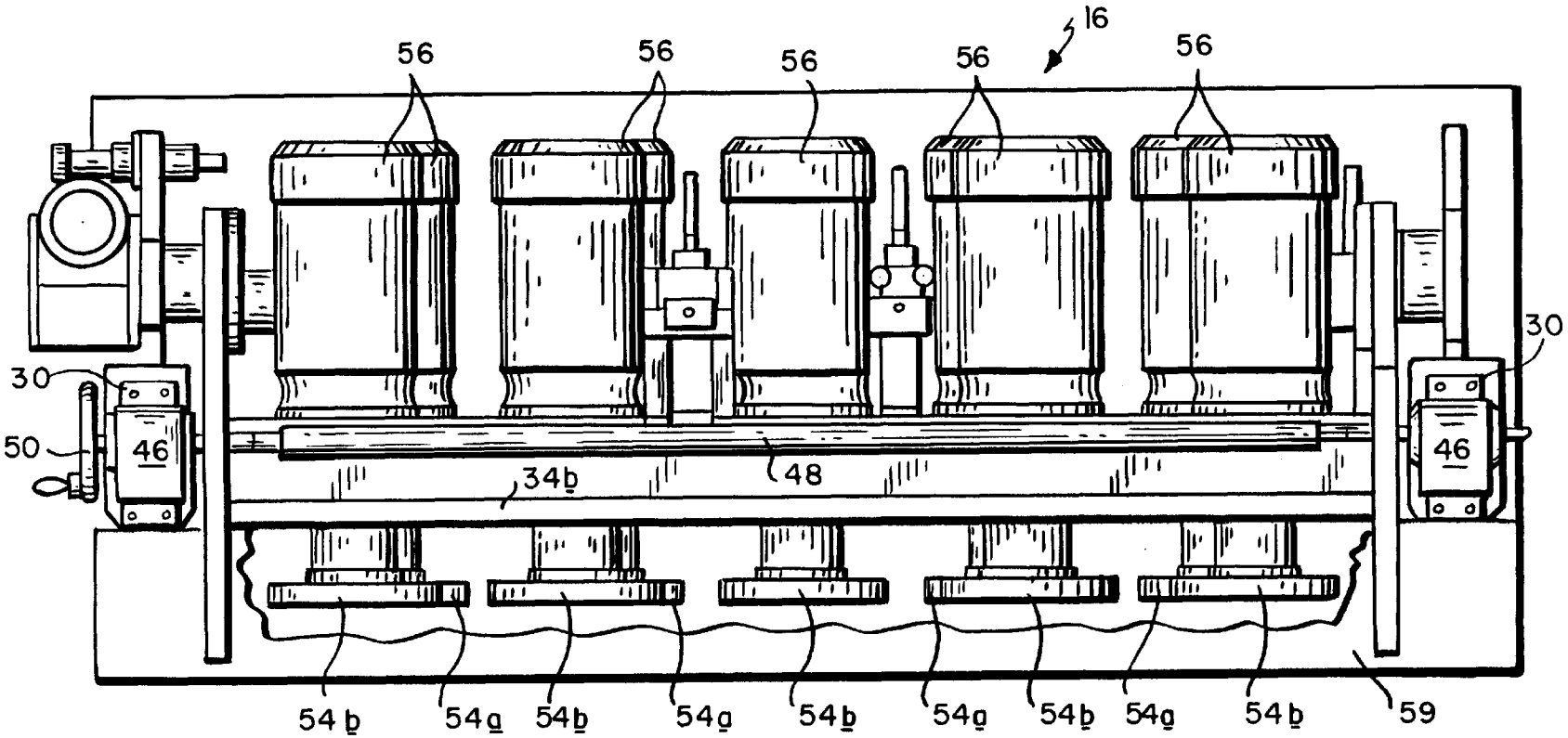
FIG. 4 is a top plan view of the turndown apparatus, again with portions of the pivotal housing cover broken away.
Figure 9:
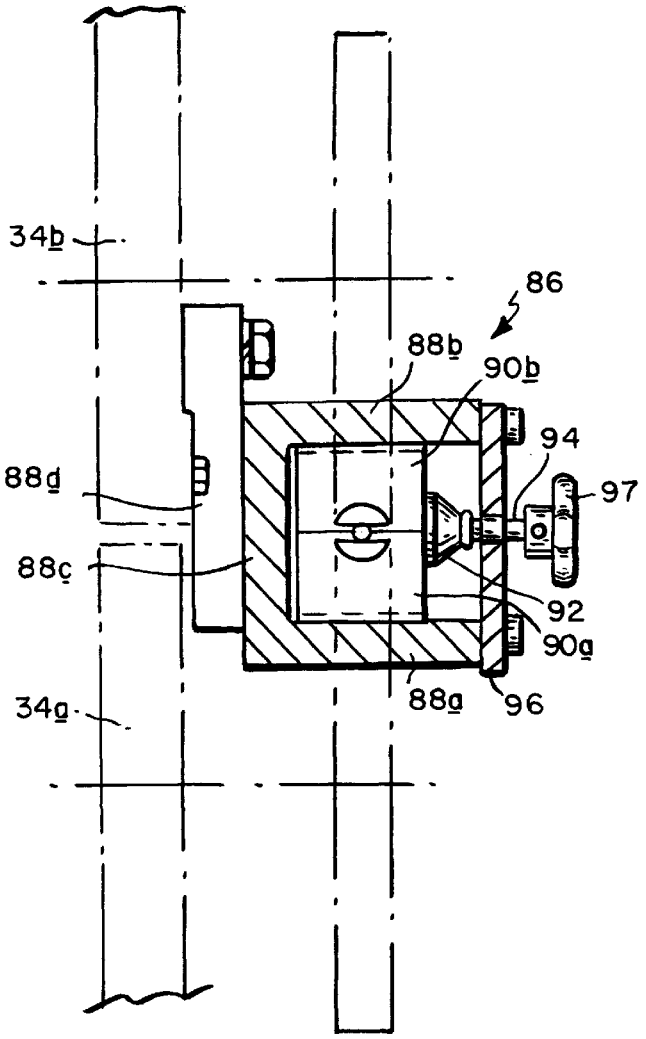
FIG. 9 is a sectional view taken through a fixed guide assembly along line 9—9 of FIG. 2.
Figure 10:
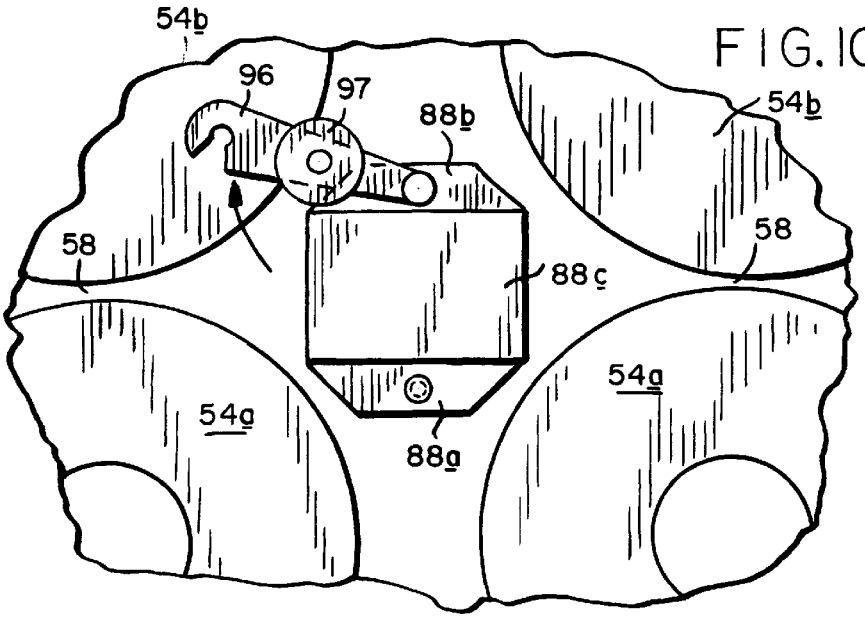
FIG. 10 is a front view showing the guide assembly of FIG. 9 open with the guide members removed therefrom.

With reference to FIGS. 2, 9 and 10, it will be seen that fixed guide assemblies 86 are located along the curved path $P_C$ in order to guide the product from one roll gap 58 to the next. Each guide assembly includes a U-shaped bracket having vertically spaced flanges 88*a,* 88*b* joined by a base 88*c,* with the latter being fixed to a plate 88*d* secured to the upper frame member 34*b*. Guide segments 90*a,* 90*b* are captured between the flanges 88*a,* 88*b,* and are held in place by the foot 92 of a spindle 94 threaded through a pivotal latch 96 and manually operable by a handwheel 97.

As shown in FIG. 10, when the spindle 94 is loosened, the latch 96 may be pivoted upwardly, thus clearing the way for a removal of one set of guide segments for exchange another set to accommodate changes in product sizes. The guide assemblies 86 move with the upper frame member 34*b,* but this is of no import given the relatively small range of adjustments required, typically ±0.5 mm.

In light of the foregoing, it will now be appreciated by those skilled in the art that the present invention represents a marked improvement over conventional turndowns. The ability to rapidly adjust the gaps between guide rollers obviates any necessity for changing from size of guide rollers to another when changing product sizes. This translates into a significant reduction in non productive down time. Additional savings are realized by not having to maintain an inventory of different sized guide rollers.

Various changes and modifications may be made to the embodiment herein disclosed without departing from the scope of the apended claims. By way of example only, and without limitation, other mechanisms including for example linear actuations, may be employed to symmetrically adjust the frame members. The adjustment mechanisms may be remotely operated by powered drives. The guide rollers on each frame member may be jointly rather than individually driven.

We claim:

1. Apparatus for guiding bars, rods and other like bendable elongated products moving longitudinally along a curved path, said apparatus comprising:

first and second guide rollers arranged respectively along the inside and outside of said curved path, said first and second guide rollers coacting in pairs to define gaps therebetween spaced along said path;

adjustment means for symmetrically shifting the guide rollers of each of said pairs in opposite directions with respect to said path to thereby vary the size of said gaps; and drive means for rotatably driving said guide rollers.

2. The apparatus as claimed in claim 1 wherein said first and second guide rollers are mounted respectively on first and second frame members, with said adjustment means acting on said frame members.

3. The apparatus as claimed in claim 2 wherein said drive means comprises a plurality of motors carried on said frame members, said drive motors each being coupled to a respective one of said guide rollers.

4. The apparatus as claimed in claim 2 wherein said adjustment means comprises opposite hand nut members fixed with respect to said frame members, said nut members coacting in threaded engagement with opposite hand screw segments on spindle shafts extending between said frame members.

5. The apparatus as claimed in claim 4 wherein said adjustment means further comprises means for simultaneously rotating said spindle shafts.

6. The apparatus as claimed in claim 2 further comprising a fixed support structure, said frame members being mechanically interengaged with and moveable relative to said support structure.

7. The apparatus as claimed in claim 6 further comprising clamp means for releasably fixing said frame members to said support structure.

8. The apparatus as claimed in claim 1 further comprising guide means extending along said path between said gaps.

9. Apparatus for guiding bendable elongated products moving longitudinally along a curved path, said apparatus comprising:

a stationary support structure;

first and second frame members mounted on said support structure;

first and second guide rollers carried respectively on said first and second frame members and arranged respectively along the inside and outside of said curved path, said first and second guide rollers coacting in pairs to define gaps therebetween lying on said path;

adjustment means acting on said frame members to symmetrically shift the guide rollers of each of said pairs in opposite directions with respect to said path to thereby vary the size of said gaps;

clamp means for releasably fixing said frame members to said support structure; and drive means for rotatably driving said guide rollers.

* * * * *